US011376602B2

(12) United States Patent
Virdis et al.

(10) Patent No.: US 11,376,602 B2
(45) Date of Patent: Jul. 5, 2022

(54) VACUUM GRINDING SYSTEM AND METHOD

(71) Applicant: FREWITT FABRIQUE DE MACHINES SA, Granges-Paccot (CH)

(72) Inventors: Antoine Virdis, Ferpicloz (CH); Christophe Pasquier, Romanens (CH)

(73) Assignee: FREWITT FABRIQUE DE MACHINES SA, Granges-Paccot (CH)

( * ) Notice: Subject to any disclaimer, the term of this patent is extended or adjusted under 35 U.S.C. 154(b) by 490 days.

(21) Appl. No.: 15/533,682

(22) PCT Filed: Dec. 7, 2015

(86) PCT No.: PCT/IB2015/059414

§ 371 (c)(1),
(2) Date: Jun. 7, 2017

(87) PCT Pub. No.: WO2016/092457

PCT Pub. Date: Jun. 16, 2016

(65) Prior Publication Data

US 2017/0326553 A1 Nov. 16, 2017

(30) Foreign Application Priority Data

Dec. 9, 2014 (CH) ..... CH01898/14

(51) Int. Cl.
*B02C 13/286* (2006.01)
*B02C 13/288* (2006.01)
(Continued)

(52) U.S. Cl.
CPC ..... *B02C 13/286* (2013.01); *B02C 13/288* (2013.01); *B02C 23/02* (2013.01);
(Continued)

(58) Field of Classification Search
CPC ..... B02C 2/007; B02C 4/286; B02C 11/04; B02C 13/286; B02C 13/288;
(Continued)

(56) References Cited

U.S. PATENT DOCUMENTS 2,964,359 A * 12/1960 Abonnenc ..... B02C 13/286 406/32
3,545,683 A * 12/1970 Schulte ..... B02C 19/06 241/1
(Continued)

FOREIGN PATENT DOCUMENTS

EP 0191696 A2 8/1986
EP 0218790 B1 4/1987
(Continued)

OTHER PUBLICATIONS

International Search Report for PCT/IB2015/059414 dated Feb. 24, 2016.
Written Opinion for PCT/IB2015/059414 dated Feb. 24, 2016.

*Primary Examiner* — Adam J Eiseman
*Assistant Examiner* — Stephen Floyd London
(74) *Attorney, Agent, or Firm* — Pearne & Gordon LLP

(57) ABSTRACT

A vacuum grinding system having multiple elements connected in series. The elements include an input chamber next to the system input, which chamber can be fluidically connected to a vacuum pump; a grinding chamber which is arranged downstream of the input chamber and which can be fluidically connected to a vacuum pump; and an output chamber, downstream of the grinding chamber and next to the output system, which output chamber can also be fluidically connected to a vacuum pump.

22 Claims, 6 Drawing Sheets

(51) Int. Cl.
*B02C 23/02* (2006.01)
*B02C 25/00* (2006.01)

(52) U.S. Cl.
CPC .... *B02C 25/00* (2013.01); *B02C 2013/28609* (2013.01); *B02C 2013/28618* (2013.01)

(58) Field of Classification Search
CPC ..... B02C 2013/28609; B02C 2013/28618; B02C 17/183; B02C 17/1835; B02C 23/02; B02C 25/00; B02C 11/06
USPC ..... 241/31, DIG. 14
See application file for complete search history.

(56) References Cited

U.S. PATENT DOCUMENTS 3,614,001 A * 10/1971 Beike ..... B02C 19/186 241/23
3,942,727 A * 3/1976 Fahlstrom ..... B02C 21/007 241/34
4,221,342 A * 9/1980 Tadema ..... B02C 17/16 241/171
4,418,871 A * 12/1983 Powell ..... B02C 19/18 209/135
5,092,528 A * 3/1992 Rudibaugh ..... B02C 18/302 241/34
5,361,996 A * 11/1994 Svensson ..... B02C 17/16 241/30
6,076,752 A * 6/2000 Paradowski ..... B02C 19/186 241/16
2011/0089274 A1* 4/2011 Amano ..... B02C 7/08 241/46.02
2014/0224905 A1* 8/2014 McKee ..... B09B 3/0091 241/18

FOREIGN PATENT DOCUMENTS

FR 2194132 A5 * 2/1974 ..... B02C 13/1807
FR 2194132 A5 2/1974
FR 2307580 A1 11/1976
FR 2628007 9/1989
JP 6198211 7/1994
JP 2006150250 A 6/2006
WO 2008001854 A1 1/2008
WO 2013079795 A1 6/2013

* cited by examiner

VACUUM GRINDING SYSTEM AND METHOD

TECHNICAL FIELD

The present invention relates to an in-line vacuum grinding system comprising a plurality of elements connected in series, of which an inlet chamber adjacent to the inlet of the system, a grinding chamber arranged downstream of the inlet chamber, and an outlet chamber, downstream of the grinding chamber, each element being capable of being connected in fluid connection to a vacuum pump. The invention also relates to the corresponding grinding method.

The invention relates more particularly to a vacuum grinding system and method suitable for powder transformation processes.

STATE OF THE ART

Patent application WO 08/001854 proposes a grinding device having an improved grinding efficiency achieved by the reduction of the air current caused by the rotation of the rolling bodies. The device crushes objects by compressing them with the rolling bodies, and in the device, a vacuum pump is connected over a grinding space for crushing the objects, the objects being ground in a vacuum environment.

Document JP 6198211 discloses a crusher using a vacuum pump to perform vacuum grinding. The vacuum pump is connected to the main body in order to carry out the grinding. A filter bag for separating air and fine particles is not required. When the air is properly evacuated, a raw material is finely ground as a whole.

Document FR 2628007 relates to a vacuum percussion crusher. The crusher comprises a tank defining a chamber with a reduced pressure provided with a linking connector with suction means, a vertical axis wheel for spraying the material at high speed by centrifugal force placed in the chamber and provided with a rotary driving motor, with a device for supplying the chamber with fragments of the material to be ground, opening out above the wheel, a target intended to receive the impact of the fragments of the material and means for evacuating the ground material collected at the bottom of the enclosure. The target consists of fragments of the material to be ground. The grinder is particularly suitable for processing low-grade ores.

Document EP0218790 relates to a method and device for continuous vacuum grinding. It comprises at least one body that can be displaced to form a chamber inside said pumping means which can be closed to the ambient air, means for filling the meat chamber, mechanical means for closing the meat-filled chamber to the ambient air and for isolating said chamber from said grinding plate, and means for removing entrapped air within the closed chamber filled with meat.

All these devices allow either continuous or high vacuum grinding, however, none of them allows the two to be cumulated. Vacuuming is a prerequisite for ensuring the quality of the grinding, for respecting the integrity of the material to be ground, in particular in the food and pharmaceutical field. The vacuum conditions established in the aforementioned devices, insofar as there is never any cumulating of continuous and high vacuum, lead to a (limited but effective) oxidation of the material to be ground and therefore to an alteration of its essential qualities.

To overcome these various disadvantages, the invention provides various technical means.

BRIEF SUMMARY OF THE INVENTION

A first object of the invention is to provide a grinding system in which the materials to be ground are placed under continuous high vacuum conditions throughout the duration of the grinding operation.

Another object of the invention is to provide a continuous and high vacuum grinding system, i.e. a vacuum such that the oxygen concentration is equal to or less than 10%, for example between 1% and 10%.

To do this, the invention provides a vacuum (in-line) grinding system comprising a plurality of elements connected in series, said elements comprising:

an inlet chamber adjacent to the inlet of the system, capable of being connected in fluid connection to a vacuum pump;

a grinding chamber, arranged downstream of the inlet chamber, capable of being connected in fluid connection to a vacuum pump; and an outlet chamber, downstream of the grinding chamber and adjacent to the outlet of the system, also capable of being connected in fluid connection to a vacuum pump.

According to such an architecture in series, the grinder allows grinding under high and continuous vacuum conditions thanks to a leak-tight separation of the various chambers and a connection to the vacuum pump possible in several places, thus at different stages of the grinding procedure. The quality of the raw material is thus preserved. The grinding system of the invention also ensures respect for the integrity of persons (operators) and equipment in the case of explosive products. Indeed, vacuum grinding makes it possible to grind potentially explosive products with much less risk than when these products are ground in the presence of oxygen. In this case, the use of inert gases is not necessary. The grinding system of the invention also makes it possible to minimize the heating during grinding and also allows a reduction in noise, in comparison with conventional grinding carried out under normal atmospheric conditions.

According to an advantageous embodiment, the inlet chamber can be isolated either from the inlet of the system or from the grinding chamber or from both simultaneously. The grinding chamber can itself be isolated either from the inlet chamber or from the outlet chamber or from both simultaneously. The outlet chamber, on the other hand, can be isolated either from the grinding chamber or from the outlet of the system, or from both simultaneously.

According to another advantageous embodiment, the vacuum grinding system comprises a grinding chamber which comprises a grinder.

According to another advantageous embodiment, the grinding system comprises a plurality of material flow control valves arranged between each of the chambers, between the inlet of the system and the inlet chamber, between the outlet chamber and the outlet of the system.

Advantageously, each of the chambers has an extraction outlet for fluid connection to a vacuum pump.

Also advantageously, the extraction outlets are provided with vacuum pumping control valves.

According to yet another embodiment, the input chamber or the grinding chamber comprises a metering device for the quantity of material to be ground.

The invention further provides a vacuum grinding method for the vacuum grinding system comprising the steps of:

opening the inlet material flow control valve to proceed with admitting the material to be ground into the inlet chamber;

after admission of the material to be ground into the inlet chamber, closing the inlet flow control valve;

(opening of the inlet chamber extraction valve) establishing a fluid connection between the inlet chamber and a vacuum pump and evacuating the inlet chamber;

opening the pre-grinding flow control valve to supply the grinding chamber with material to be ground;

after admission of the material to be ground into the grinding chamber, closing the grinding flow control valve;

grinding the material using the grinder;

opening the post-grinding flow control valve to ensure that the ground material passes into the outlet chamber;

closing the post-grinding flow control valve;

reducing or stopping the air-evacuation of the outlet chamber;

waiting for the pressure at the outlet chamber to reach a predetermined output threshold; and opening the outlet flow control valve to carry out the passage of the ground material from the outlet chamber to the outlet of the grinding system.

According to yet another variant embodiment, the grinding process comprises a prior step consisting in closing all the material flow valves and performing at least partial evacuation of each of the chambers of the grinding system before initiating the step of opening the flow control valve.

According to yet another variant embodiment, the grinding step is preceded by a step of metering the quantity of material to be admitted to the grinder.

BRIEF DESCRIPTION OF THE DRAWINGS

Examples of embodiments of the invention are indicated in the description illustrated by the attached figures in which.

EXAMPLE(S) OF EMBODIMENTS OF THE INVENTION

Figure 1:
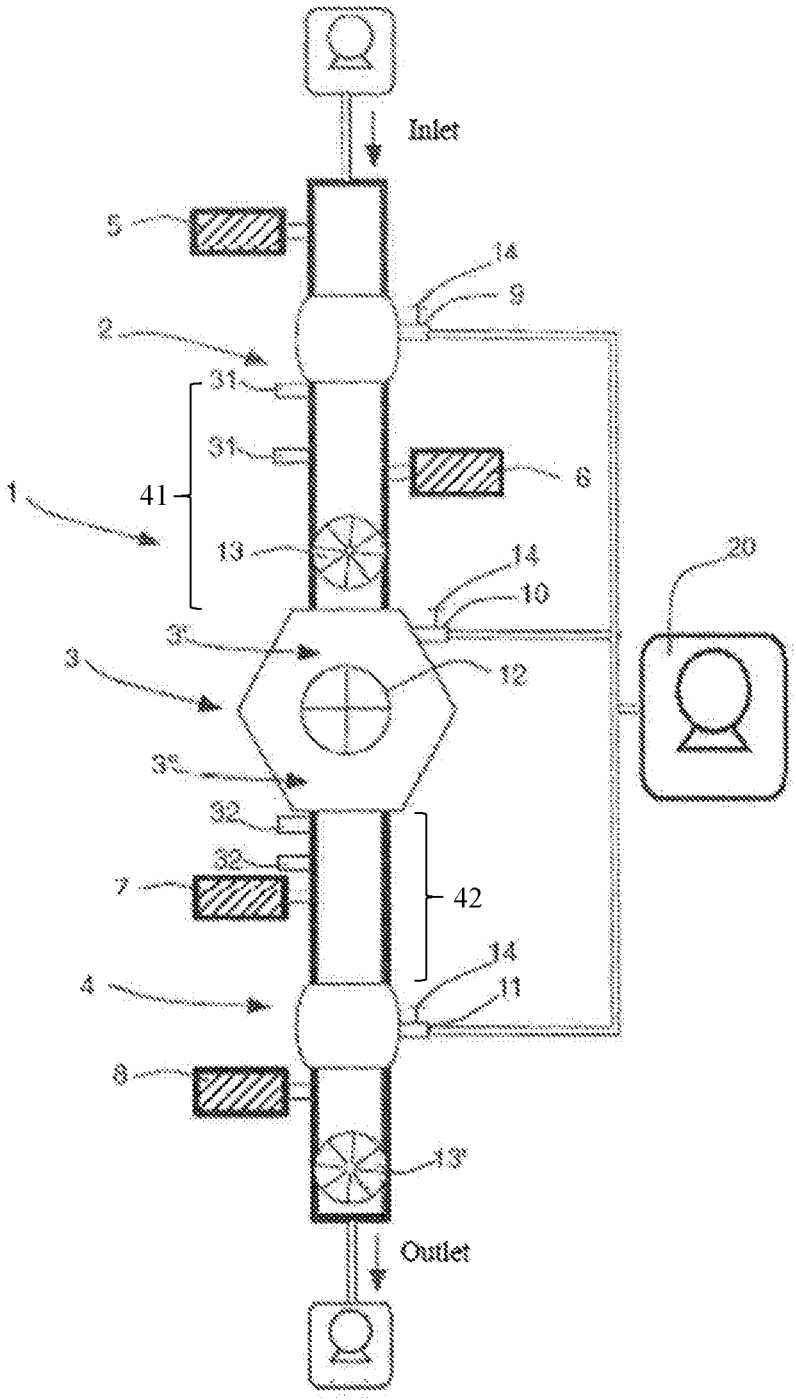
FIG. 1 is a schematic view of the device as a whole according to the invention.

FIG. 1 illustrates an embodiment in which the grinding system is shown schematically. The inlet chamber 2 is provided with a leak-tight material flow control valve 5, ensuring perfectly hermetic isolation of said chamber from the inlet of the system.

This chamber can also be connected to a vacuum pump 20 via an extraction outlet 9, which makes it possible to place the chamber in question under vacuum. The grinding chamber 3 comprises a grinder 12. It is also provided with an extraction outlet 10 for fluid connection to a vacuum pump 20 and a leak-tight grinding flow control valve 6 making it possible to place said grinding chamber under vacuum at a substantially similar pressure to that of the chamber 2, thus guaranteeing that the material to be ground is maintained in continuous high vacuum conditions when it passes from one chamber to the other. The extraction outlet 10 is actuated by a valve actuator 14 based on an actuation of the pneumatic, electric, manual or other type. A flow regulator (or doser) 13 makes it possible to control the quantity of material transmitted to the grinding chamber. The flow regulator 13 also makes it possible to fluidize the material to be ground and therefore to fluidize the flow of the material to be ground entering the grinding chamber 3.

It is thus possible to ensure that only a reasonable quantity of material is transmitted to the grinder, thus guaranteeing quality grinding and avoiding any obstruction of the grinder 12. The outlet chamber 4 is provided with two material flow control valves, one upstream 7 and the other downstream 8, as well as an extraction outlet 11 for fluid connection with a vacuum pump 20 for receiving the ground material under vacuum conditions similar to those of the grinding chamber 3, thus ensuring the continuity of the high vacuum in the system. The extraction outlet 11 can also be actuated by a valve actuator 14.

This system also makes it possible to reduce the air evacuation of said outlet chamber 4 in order to reach a predetermined threshold adapted to the output of the ground material of the system, which output can be controlled by means of the outflow control valve 8.

In one embodiment, the high vacuum corresponds to a vacuum resulting in an oxygen concentration which is equal to or less than 10%, for example between 1% and 10%. In relation to the sea level, where the atmosphere is composed of 20.8% oxygen at an absolute pressure of 1.013 bar, a value of 7% or less is to be reached (corresponding to a pressure lower than or equal to 0.34 bar absolute). The measurement of the oxygen content can be carried out by means of a measurement of the pressure (or of the vacuum) in each of the chambers for inlet 2, grinding 3 and outlet 4. The pressure measurement is directly related to the oxygen concentration in the chamber 2, 3, 4 and allows a shorter response time for the oxygen percentage measurement, for example, than a measurement of the oxygen concentration based on a chemical reaction.

In a variant, the vacuum grinding system 1 comprises a second flow regulator 13' placed in or after the outlet chamber 4 and making it possible to control the quantity of ground material leaving the outlet chamber 4. The second flow regulator 13' can also be connected to the outlet flow control valve 8 so as to meter determined quantities of ground material. In yet another variant, the second flow regulator 13' and/or the outlet flow control valve 8 may be connected to a balance (not shown) so as to meter the ground material according to set-point weight values.

Figure 2:
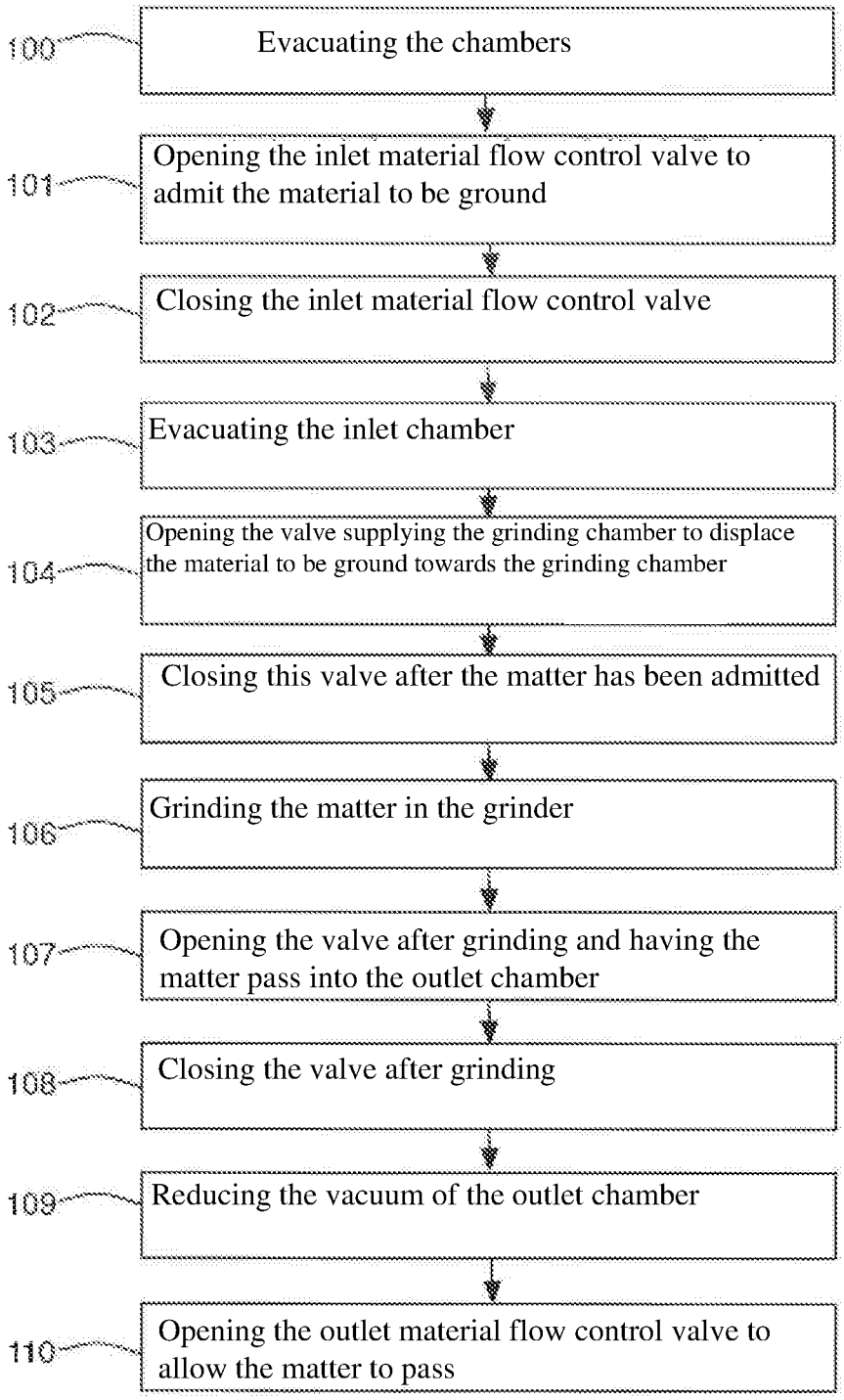
FIG. 2 is a flow chart showing the various steps of the grinding process.
Figure 3:
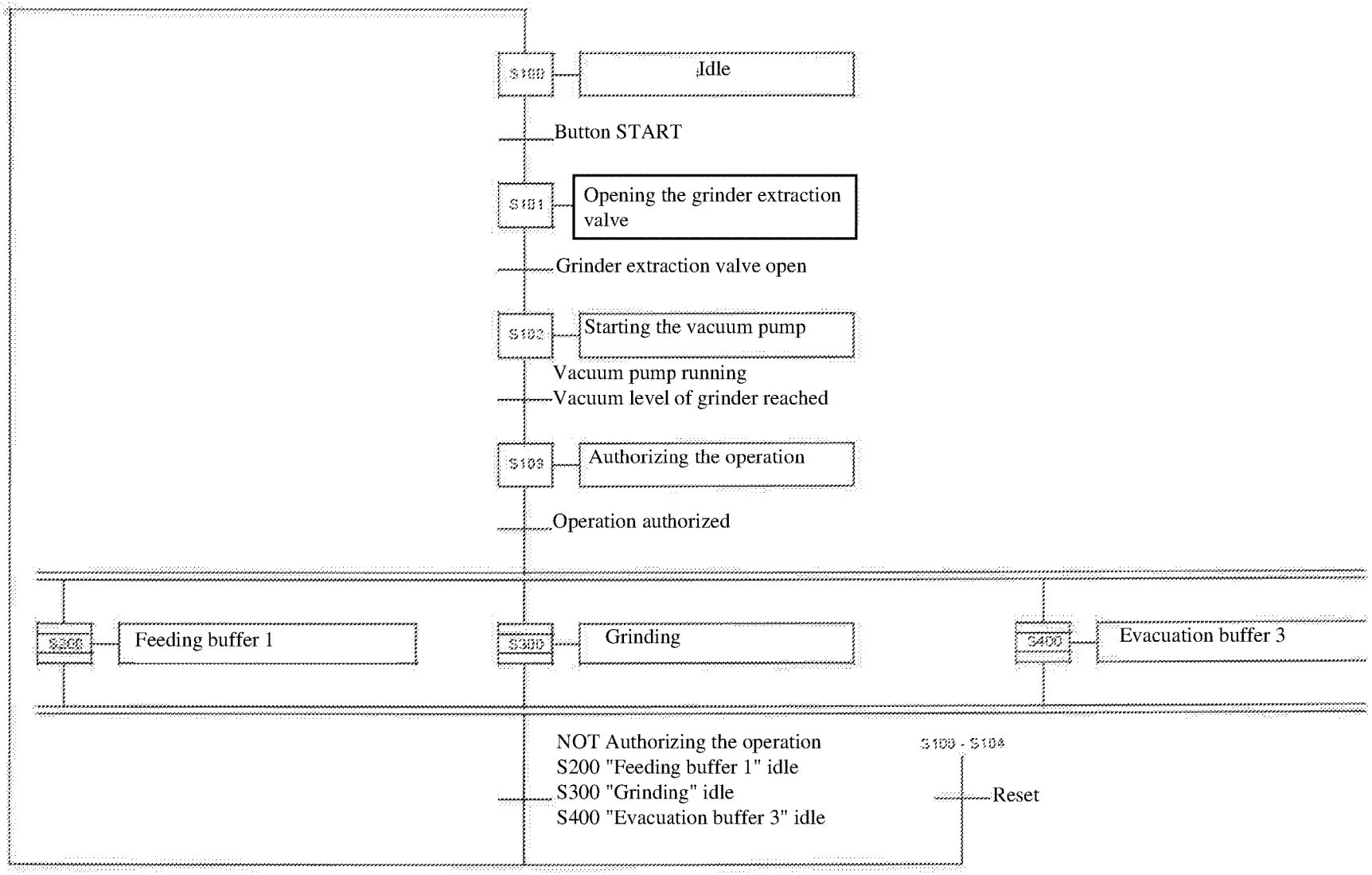
FIG. 3 comprises a general sequence of operation of the grinding system, according to one embodiment.

FIG. 2 illustrates the main steps of a grinding process for a vacuum grinding system 1 according to the invention. In step 100, the various chambers 2, 3, 4 of the system are evacuated.

In step 101, the inlet material flow control valve 5 is opened to accommodate the material to be ground in the inlet chamber 2. Step 102 consists in closing the inlet material flow control valve 5 upon admission of the material into the inlet chamber 2.

In step 103, air is evacuated from the inlet chamber 2. This evacuation makes it possible to remove the air that came in at the time of admission of the material to be ground into the inlet chamber 2. This phase is important to ensure that the vacuum of the grinding chamber 3 is not affected.

In step 104, the opening of the valve 6 feeding the grinding chamber 3 takes place in order to allow the material to be ground to be transferred from the inlet chamber 2 to the grinder 12. Step 105 relates to the closing of said valve 6 feeding the grinding chamber 3 after passage of the material.

In step 106, the grinding of the material takes place in the grinder 12. Step 107 consists in opening the post-grinding valve 7 in order to allow the ground material to pass from the grinding chamber 3 into the outlet chamber 4.

The step 108 consists in closing the post-grinding valve 7. At step 109, there is a reduction in the evacuation of the outlet chamber 4 to prevent a pressure differential from perturbing the flow of material from the outlet chamber 4 to the outlet of the system, or to prevent a backflow from occurring.

Finally, step 110 is characterized by opening the outlet flow valve 8 to allow the ground material resulting from the process to exit.

During the opening of the valve 6 feeding the grinding chamber 3 (step 4), the material to be ground is transmitted from the inlet chamber 2 to the inlet 3' of the grinding chamber 3. During the grinding step (step 106), the material is ground in the grinder 12 and the ground material flows to the outlet 3" of the grinding chamber 3.

The steps 100 to 110 of the grinding process can be repeated so as to provide continuous grinding material.

According to one embodiment, the grinding process comprises repeating the steps of:

opening the inlet material flow control valve 5 in order to receive material to be ground in the inlet chamber 2 (step 101);

closing the inlet material flow control valve 5 after the material has been admitted into the inlet chamber 2 (step 102);

evacuating the air from the inlet chamber 2 (step 103);

opening the valve 6 feeding the grinding chamber 3 (step 104);

and closing said valve 6 (step 105);

before the material to be ground previously introduced into the grinding chamber 3 has been completely ground (step 106).

In this embodiment, new material to be ground is therefore transmitted from the inlet chamber 2 to the grinding chamber 3 before the material to be ground previously introduced into the grinding chamber 3 has been completely ground. The inlet chamber 2 (i.e. the volume comprised between the inlet material flow control valve 5 and the valve 6 feeding the grinding chamber) then serves as a buffer zone for the new material that is to be received in the grinding chamber 3. The output 3" (i.e. the volume between the grinder 12 and the post-grinding flow control valve 7) also serves as a buffer zone for the ground material.

The material flow and the grinding flow (or grinding speed) and the amount of material to be ground that is received in the inlet chamber 2 can be adjusted so that the grinding process operates continuously, i.e. the vacuum grinding system 1 can supply grinder material continuously.

The figures and their descriptions given above illustrate the invention rather than limit it. In particular, the invention and its various variants have just been described in connection with a particular example comprising a grinding system substantially in line.

Nevertheless, it is obvious to a person skilled in the art that the invention can be extended to other embodiments in which, in variants, a grinding system in the form of a "U", "L" etc. is provided.

In a variant, the grinding system 1 comprises two grinding chambers 3 in series, in order to ensure a substantially constant and durable quality.

Still in one embodiment, the grinding system 1 comprises one or several level-sensors, whose purpose is to indicate the presence or not of the material to be ground or of the ground material in one of the chambers 2, 3, 4. To this end, the sensor may be a radar, ultrasonic, capacitive or radiometric level-sensor.

In one configuration of the grinding system 1, a first level-sensor 31 is included between the inlet chamber 2 and the grinding chamber 3 and a second level-sensor 32 is included between the grinding chamber 3 and the outlet chamber 4. The signaling coming from the first level-sensor 31 will cause the fluid connection to be established between the inlet chamber 2 and the grinding chamber 3 (by activating the valve 6 feeding the grinding chamber), in the absence of material. In the presence of material, the signaling coming from the first level-sensor 31 will cause the fluid connection between the inlet chamber 2 and the grinding chamber 3 to be interrupted (by stopping the valve 6 feeding the grinding chamber). Similarly, the signaling coming from the second level-sensor 32 will cause the fluid connection between the grinding chamber 3 and the chamber 4 to be established (by activating the post-grinding flow control valve 7) and the interruption of the fluid connection between the grinding chamber 3 and the chamber 4 (by stopping the post-grinding flow control valve 7), respectively in the absence and in the presence of material. In this way, the grinding system 1 can be completely automated.

In a preferred configuration, the first level-sensor comprises a sensor 31 at the top and at the bottom of the accumulation zone 41 between the inlet chamber 2 and the grinding chamber 3. The second level-sensor comprises a sensor 32 at the top and at the bottom of the accumulation zone 42 between the grinding chamber 3 and the outlet chamber 4. For example, the first sensor 31 may be placed at the outlet of the inlet chamber 2 (downwardly in FIG. 1) after the grinding flow control valve 6 and at the inlet of the grinding chamber 3, before the flow regulator 13. The second sensor 32 can be placed at the outlet of the grinding chamber 3 and at the inlet of the outlet chamber 4 before the post-grinding flow control valve 7.

FIGS. 3 to 6 show algorithms comprising sequences of automatic operating steps of the grinding system 1 according to one embodiment. In particular, FIG. 3 comprises a general sequence of operation of the grinding system 1. The initially idle grinding system (S100) is started by opening the valve feeding the grinding chamber 6 (grinder extraction valve, S101), followed by starting the vacuum pump 20 (S102) and by authorizing the operation (S103).

Figure 4:
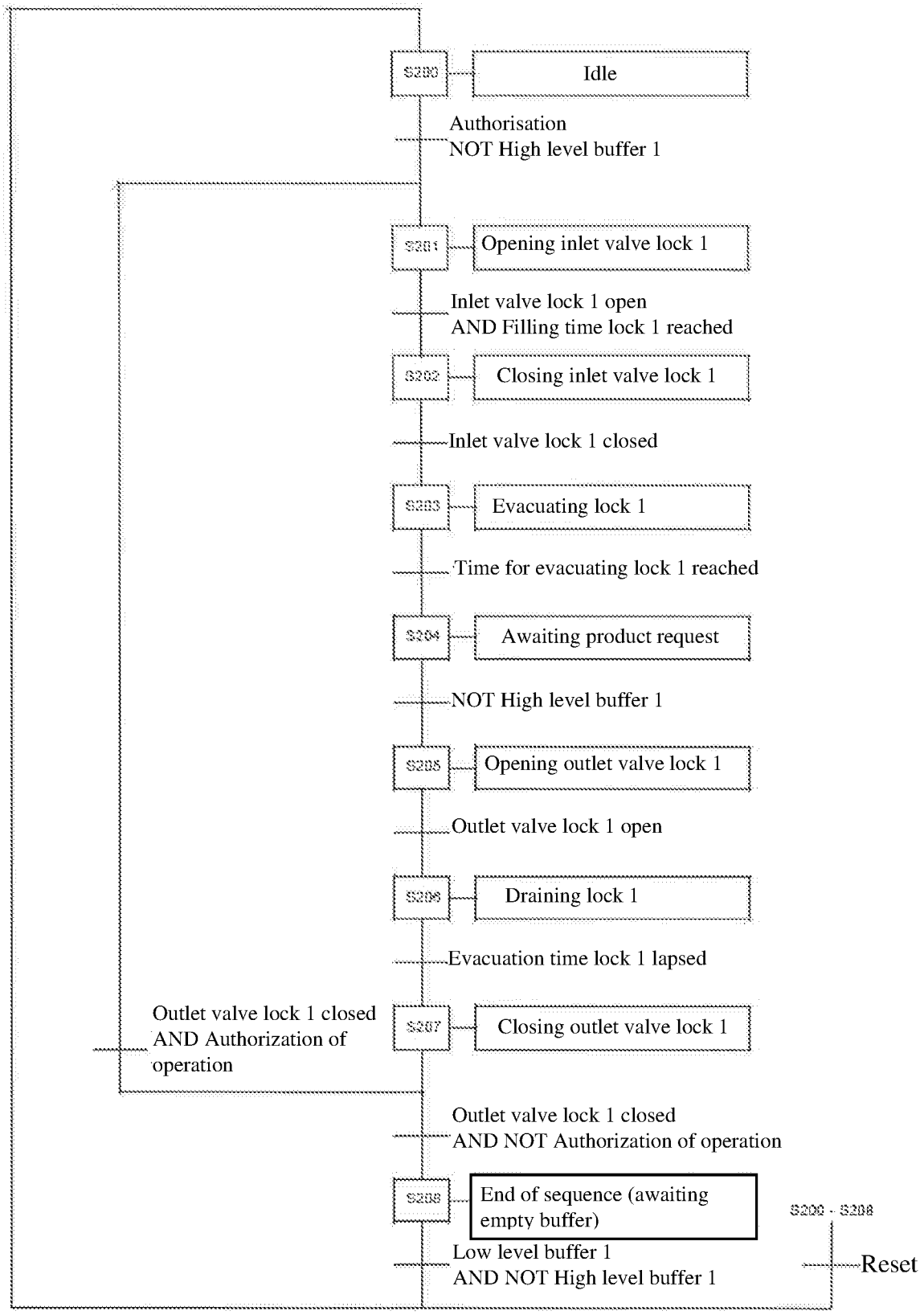
FIG. 4 shows a sequence of the steps of letting the material into the grinding chamber, according to one embodiment.

FIG. 4 shows the sequence of steps from the material entry into the grinding chamber. That is, after resting (S200), the steps comprising opening the inlet material flow control valve (inlet valve lock 1, S201) and closing it (S202) after filling the material in the inlet chamber 2; the air evacuation of the inlet chamber 2 (evacuation lock 1, S203); the opening of the valve supplying the grinding chamber 6 (outlet valve 1 lock, S205) after a certain period of time (awaiting product request, S204) emptying the inlet chamber 2 of the material (drain valve lock 1, S206); and closing the valve feeding the grinding chamber 6 (outlet valve lock 1, S207). Step S208 corresponds to the end of this sequence, once the inlet chamber 2 is empty of material.

Figure 5:
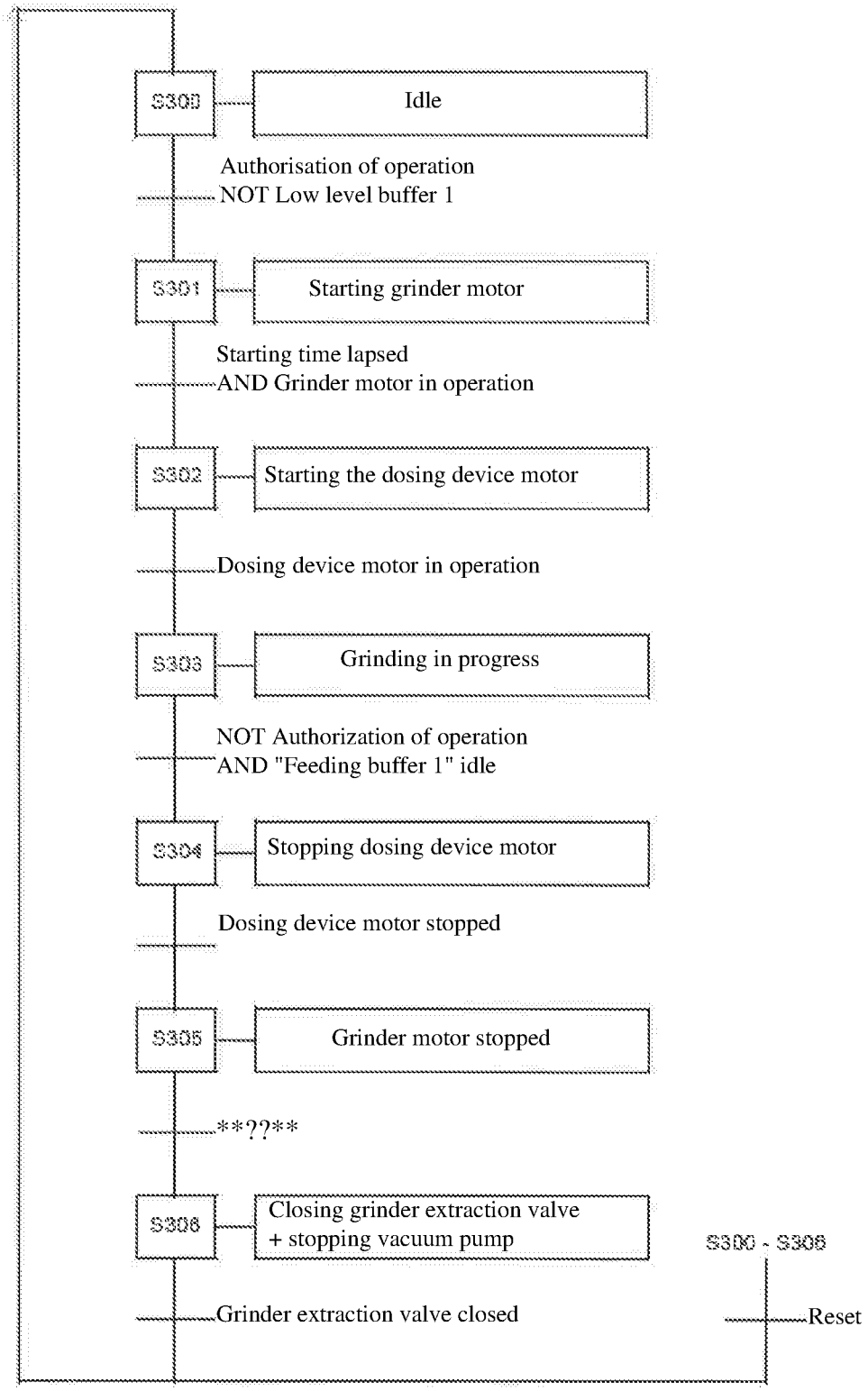
FIG. 5 shows the sequence of grinding steps, according to one embodiment.

FIG. 5 shows the sequence of grinding steps and, in particular: starting the grinder (starting the grinder motor, S301) after the resting step (S300); starting the dosing device 13 (S302); grinding step (S303); stopping the dosing device 13 (S304); stopping the grinder (S305); and closing the post-grinding flow control valve 7 (grinder outlet valve) and stopping the vacuum pump 20 (S306).

Figure 6:
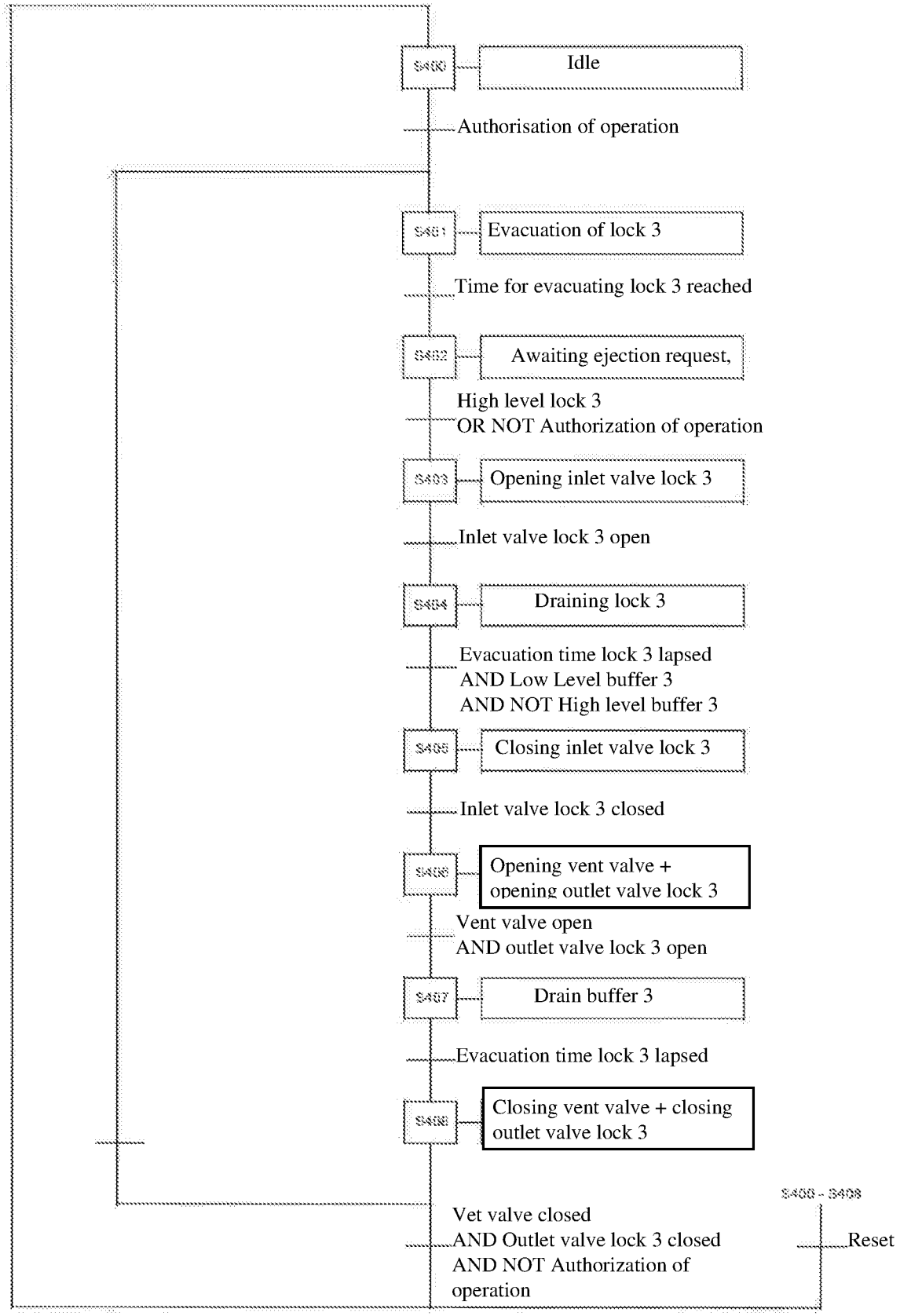
FIG. 6 shows the sequence of steps after the grinding steps, according to one embodiment.

FIG. 6 shows the sequence of the following steps, after the resting (S400): evacuating the outlet chamber 4 (evacuation of the lock 3, S401); a step of waiting before the ground material exits from the grinding chamber 3 (awaiting ejection request, S402); opening the post-grinding flow control valve 7 (inlet valve lock 3, S403); extracting the ground material from the grinding chamber 3 (draining lock 3, S404); closing the post-grinding flow control valve 7 (closing inlet valve lock 3, S405); opening the outlet flow control valve 8 (opening valve outlet lock 3, S406); extracting the ground material from the outlet chamber 4 (buffer drain 3, S407); and closing the outlet flow control valve 8 (closing outlet valve lock 3, S408).

The references in the claims are not limiting. The verbs "to comprise" and "to include" do not exclude the presence of elements other than those listed in the claims. The word "one"/"a(n)" preceding an element does not exclude the presence of a plurality of such elements.

REFERENCE NUMBERS USED IN THE FIGURES

1 Vacuum grinding system
2 Inlet chamber
3 Grinding chamber
3' Inlet of the grinding chamber
3" Outlet of the grinding chamber
4 Outlet chamber
5 Flow control valve for input material
6 Valve feeding the grinding chamber
7 Post-grinding flow control valve
8 Outlet flow control valve
9, 10, 11 Extraction outlet
12 Grinder
13 Flow regulator, doser
13' Second flow regulator, second doser
14 Actuator of the valve
20 Vacuum pump
31 First level-sensor
32 Second level-sensor

What is claimed is:

1. A continuous vacuum grinding system having a plurality of elements connected in series, said elements comprising:

an inlet chamber adjacent to an inlet of the system, the inlet chamber being provided with an inlet material flow control valve arranged, when opened, to accommodate a material to be ground in the inlet chamber, the inlet chamber being configured to be connected in fluid connection to a vacuum pump;

a grinding chamber comprising a grinder arranged downstream of the inlet chamber and provided with a grinding flow control valve configured, when opened, to allow the material to be ground to be transferred from the inlet chamber to the grinding chamber, the grinding chamber being connected in fluid connection to the vacuum pump; and an outlet chamber, downstream of the grinding chamber and adjacent to an outlet of the system, the outlet chamber being provided with a post-grinding flow control valve configured, when opened, to allow ground material to pass from the grinding chamber into the outlet chamber, the outlet chamber being in fluid connection to the vacuum pump, the outlet chamber further comprising an outlet flow valve configured, when opened, to output the ground material;

the system being configured to control-opening and closing of the inlet material flow control valve, the grinding flow control valve, the post-grinding flow control valve and the outlet flow valve to maintain the grinding chamber under vacuum at an oxygen concentration equal to or less than 10% in the absence of inert gas while the material to be ground is transmitted from the inlet chamber to the grinding chamber before the material to be ground previously introduced into the grinding chamber has been completely ground, wherein the inlet chamber and the grinding chamber are maintained under vacuum by the vacuum pump;

wherein the opening and closing of the inlet material flow control valve and of the grinding flow control valve are controlled, in this order, to open the inlet material flow control valve, close the inlet material flow control valve, open the grinding flow control valve, close the grinding flow control valve, open the post-grinding flow control valve, close the post-grinding flow control valve and open the outlet flow valve;

wherein an outlet level-sensor is included between the inlet chamber and the outlet chamber, the outlet level-sensor comprising a sensor at an outlet of the grinding chamber and a sensor at an inlet of the outlet chamber before the post-grinding flow control valve; and wherein a signal from the outlet level-sensor controls the opening and closing of the post-grinding flow control valve such as to generate an outlet accumulation zone of the ground material between the grinder and the post-grinding flow control valve.

2. The continuous vacuum grinding system according to claim 1, wherein:

the inlet chamber is capable of being isolated either from the inlet of the system or from the grinding chamber or from both simultaneously;

the grinding chamber can be isolated either from the inlet chamber or from the outlet chamber or from both simultaneously;

the outlet chamber can be isolated either from the grinding chamber or from the outlet of the system, or from both simultaneously.

3. The continuous vacuum grinding system according to claim 1, wherein the outlet flow valve is arranged between the outlet chamber and the outlet of the system.

4. The continuous vacuum grinding system according to claim 3, further comprising a flow regulator for controlling an amount of ground material exiting the outlet chamber, wherein the flow regulator is connected to the outlet flow valve so as to meter determined quantities of ground material.

5. The continuous vacuum grinding system according to claim 1, wherein each of the chambers has an extraction outlet for fluid connection to the vacuum pump.

6. The continuous vacuum grinding system according to claim 5, in which the extraction outlets are provided with vacuum pumping control valves.

7. The continuous vacuum grinding system according to claim 1, in which the inlet chamber or the grinding chamber has a first flow regulator for controlling a quantity of material to be ground.

8. The continuous vacuum grinding system according to claim 7, further comprising a second flow regulator for controlling an amount of ground material exiting the outlet chamber.

9. The continuous vacuum grinding system according to claim 1, wherein an inlet level-sensor is provided between the inlet chamber and the grinding chamber.

10. The continuous vacuum grinding system according to claim 9, wherein the inlet level-sensor comprises a sensor at a top and at a bottom of an inlet accumulation zone between the inlet chamber and the grinding chamber.

11. The continuous vacuum grinding system according to claim 1, wherein the grinding chamber is maintained under vacuum at an oxygen concentration equal to or less than 7%, and the grinding chamber is maintained at a pressure equal to or less than 0.34 bar absolute.

12. A continuous vacuum grinding method for a vacuum grinding system comprising a plurality of elements connected in series, said elements comprising: an inlet chamber adjacent to an inlet of the system, the inlet chamber being provided with an inlet material flow control valve arranged, when opened, to accommodate a material to be ground in the inlet chamber, the inlet chamber being configured to be connected in fluid connection to a vacuum pump; a grinding chamber comprising a grinder, arranged downstream of the inlet chamber and provided with a grinding flow control valve configured, when opened, to allow the material to be ground to be transferred from the inlet chamber to the grinding chamber, the grinding chamber being connected in fluid connection to the vacuum pump; and an outlet chamber, downstream of the grinding chamber and adjacent to an outlet of the system, the outlet chamber being provided with a post-grinding flow control valve configured, when opened, to allow ground material to pass from the grinding chamber into the outlet chamber, the outlet chamber being in fluid connection to the vacuum pump; the system being configured to control-opening and closing of the inlet material flow control valve and of the grinding flow control valve to maintain the grinding chamber under vacuum at an oxygen concentration equal to or less than 10% in the absence of inert gas while the material to be ground is transmitted from the inlet chamber to the grinding chamber before the material to be ground previously introduced into the grinding chamber has been completely ground, wherein the inlet chamber and the grinding chamber are maintained under vacuum by the vacuum pump, wherein an outlet level-sensor is included between the inlet chamber and the outlet chamber, the outlet level-sensor comprising a sensor at an outlet of the grinding chamber and a sensor at an inlet of the outlet chamber before the post-grinding flow control valve; and wherein a signal from the outlet level-sensor controls the opening and closing of the post-grinding flow control valve such as to generate an outlet accumulation zone of the ground material between the grinder and the post-grinding flow control valve;

the method comprising the steps of, in this order:

opening the inlet material flow control valve and admitting the material to be ground into the inlet chamber;

after admission of the material to be ground into the inlet chamber, closing the inlet material flow control valve and evacuating the inlet chamber;

opening the grinding flow control valve for establishing a fluid connection between the inlet chamber and the grinding chamber to supply the grinding chamber with the material to be ground;

after admission of the material to be ground into the grinding chamber, interrupting the fluid connection between the inlet chamber and the grinding chamber by closing the grinding flow control valve;

grinding the material using the grinder;

opening the post-grinding flow control valve for establishing a fluid connection between the grinding chamber and the outlet chamber to ensure that the ground material passes into the outlet chamber;

interrupting the fluid connection between the grinding chamber and the outlet chamber by closing the post-grinding flow control valve;

reducing or stopping an air-evacuation of the outlet chamber until a pressure of the outlet chamber reaches a predetermined output threshold;

carrying out the passage of the ground material from the outlet chamber to the outlet of the vacuum grinding system by opening an outlet flow valve; and controlling the opening and closing of the inlet material flow control valve and of the grinding flow control valve to maintain the grinding chamber under vacuum at the oxygen concentration equal to or less than 10% in the absence of inert gas while the material to be ground is transmitted from the inlet chamber to the grinding chamber before the material to be ground previously introduced into the grinding chamber has been completely ground, wherein the inlet chamber and the grinding chamber are maintained under vacuum by the vacuum pump.

13. The method according to claim 12, wherein said inlet material flow control valve is closed before evacuating air from the inlet chamber.

14. The method according to claim 12, wherein the passage of the ground material from the outlet chamber to the outlet of the vacuum grinding system is effected by opening said outlet flow valve.

15. The method according to claim 14, comprising a preliminary step of closing all material flow valves and at least partially evacuating each of the chambers of the vacuum grinding system before initiating the step of opening the inlet material flow control valve.

16. The method according to claim 12, wherein the grinding step is preceded by a step of metering a quantity of material to be admitted at the grinder.

17. The method according to claim 12, wherein the step of passing the ground material from the outlet chamber to the outlet of the vacuum grinding system is preceded by a step of metering an amount of the ground material.

18. The method according to claim 12, wherein the steps of the grinding method are repeated so as to provide continuous grinding material.

19. The method according to claim 12, wherein the vacuum grinding system comprises an inlet level-sensor between the inlet chamber and the grinding chamber and wherein the establishing or interrupting of the fluid connection between the inlet chamber and the grinding chamber is controlled by a signaling of the inlet level-sensor respectively in the presence and in the absence of material.

20. The method according to claim 19, wherein the outlet level-sensor is disposed between the grinding chamber and the outlet chamber and wherein the establishing or interrupting of the fluid connection between the grinding chamber and the outlet chamber is controlled by the signal of the outlet level-sensor respectively in the presence and in the absence of material.

21. A continuous vacuum grinding system having a plurality of elements connected in series, said elements comprising:

an inlet chamber adjacent to an inlet of the system, the inlet chamber being provided with an inlet material flow control valve arranged, when opened, to accommodate the material to be ground in the inlet chamber, the inlet chamber being configured to be connected in fluid connection to a vacuum pump;

a grinding chamber comprising a grinder, arranged downstream of the inlet chamber and provided with a grinding flow control valve configured, when opened, to allow the material to be ground to be transferred from the inlet chamber to the grinding chamber, the grinding chamber being connected in fluid connection to the vacuum pump; and an outlet chamber, downstream of the grinding chamber and adjacent to an outlet of the system, the outlet chamber being provided with a post-grinding flow control valve configured, when opened, to allow the ground material to pass from the grinding chamber into the outlet chamber, the outlet chamber being in fluid connection to the vacuum pump, the outlet chamber further comprising an outlet flow valve configured, when opened, to output the ground material;

the system being configured to control-opening and closing of the inlet material flow control valve, the grinding flow control valve, the post-grinding flow control valve and the outlet flow valve to maintain the grinding chamber under vacuum at an oxygen concentration equal to or less than 10% in the absence of inert gas while the material to be ground is transmitted from the inlet chamber to the grinding chamber before the material to be ground previously introduced into the grinding chamber has been completely ground, wherein the inlet chamber and the grinding chamber are maintained under vacuum by the vacuum pump;

the system further comprising a first flow regulator for controlling a quantity of material to be ground, the first flow regulator being between the grinding flow control valve and the grinding chamber; and a second flow regulator for controlling an amount of ground material exiting the outlet chamber, the second flow regulator being downstream of the outlet flow valve wherein an outlet level-sensor is included between the inlet chamber and the outlet chamber, the outlet level-sensor comprising a sensor at an outlet of the grinding chamber and a sensor at an inlet of the outlet chamber before the post-grinding flow control valve; and wherein a signal from the outlet level-sensor controls the opening and closing of the post-grinding flow control valve such as to generate an outlet accumulation zone of the ground material between the grinder and the post-grinding flow control valve.

22. A continuous vacuum grinding system having a plurality of elements connected in series, said elements comprising:

an inlet chamber adjacent to an inlet of the system, the inlet chamber being provided with an inlet material flow control valve arranged, when opened, to accommodate the material to be ground in the inlet chamber, the inlet chamber being configured to be connected in fluid connection to a vacuum pump;

a grinding chamber comprising a grinder, arranged downstream of the inlet chamber and provided with a grinding flow control valve configured, when opened, to allow the material to be ground to be transferred from the inlet chamber to the grinding chamber, the grinding chamber being connected in fluid connection to the vacuum pump; and an outlet chamber, downstream of the grinding chamber and adjacent to an outlet of the system, the outlet chamber being provided with a post-grinding flow control valve configured, when opened, to allow the ground material to pass from the grinding chamber into the outlet chamber, the outlet chamber being in fluid connection to the vacuum pump, the outlet chamber further comprising an outlet flow valve configured, when opened, to output the ground material;

the system being configured to control-opening and closing of the inlet material flow control valve, the grinding flow control valve, the post-grinding flow control valve and the outlet flow valve to maintain the grinding chamber under vacuum at an oxygen concentration equal to or less than 10% in the absence of inert gas while the material to be ground is transmitted from the inlet chamber to the grinding chamber before the material to be ground previously introduced into the grinding chamber has been completely ground, wherein the inlet chamber and the grinding chamber are maintained under vacuum by the vacuum pump;

the system further comprising a first flow regulator for controlling a quantity of material to be ground and an inlet level-sensor provided between the inlet chamber and the first flow regulator; and an outlet level-sensor provided between the inlet chamber and the outlet chamber, the outlet level-sensor comprising a sensor at an outlet of the grinding chamber and a sensor at an inlet of the outlet chamber before the post-grinding flow control valve; and wherein a signal from the outlet level-sensor controls the opening and closing of the post-grinding flow control valve such as to generate an outlet accumulation zone of the ground material between the grinder and the post-grinding flow control valve.

* * * * *